US008491021B2

(12) United States Patent
Binder et al.

(10) Patent No.: US 8,491,021 B2
(45) Date of Patent: Jul. 23, 2013

(54) APPARATUS FOR OPENING A DOOR OF A CLIMATIC TEST CABINET, AN INCUBATOR, AN ENVIRONMENTAL SIMULATION CHAMBER OR A FREEZER OR THE LIKE

(75) Inventors: Peter Michael Binder, Nenzingen (DE); Andreas Stoerk, Wurmlingen (DE)

(73) Assignee: Binder GmbH, Tuttlingen (DE)

( * ) Notice: Subject to any disclaimer, the term of this patent is extended or adjusted under 35 U.S.C. 154(b) by 8 days.

(21) Appl. No.: 12/799,980

(22) Filed: May 5, 2010

(65) Prior Publication Data

US 2010/0283360 A1 Nov. 11, 2010

(30) Foreign Application Priority Data

May 8, 2009 (DE) ..... 10 2009 020 498

(51) Int. Cl.
*E05C 3/06* (2006.01)
*E05C 3/00* (2006.01)

(52) U.S. Cl.
USPC ..... 292/201; 292/216

(58) Field of Classification Search
USPC ..... 292/201, 216
See application file for complete search history.

(56) References Cited

U.S. PATENT DOCUMENTS 2,754,144 A * 7/1956 Timms et al. ..... 292/201
3,576,337 A * 4/1971 Gudde ..... 292/201
3,749,435 A * 7/1973 Balzano ..... 292/341.16
3,942,828 A * 3/1976 Bourrie et al. ..... 292/201
3,988,859 A * 11/1976 Peterson ..... 49/394
4,030,322 A * 6/1977 Pettit ..... 70/159
4,129,325 A * 12/1978 Hern et al. ..... 292/127
4,131,306 A * 12/1978 Sokoly et al. ..... 292/201
4,182,539 A * 1/1980 Busch ..... 312/333
4,470,625 A * 9/1984 Walsh et al. ..... 292/201
4,509,347 A * 4/1985 Young ..... 70/129
4,540,208 A * 9/1985 Logan et al. ..... 292/341.19
4,579,376 A * 4/1986 Charlton ..... 292/144
4,691,542 A * 9/1987 Young ..... 70/129
4,691,584 A * 9/1987 Takaishi et al. ..... 74/471 R
4,821,521 A * 4/1989 Schuler ..... 60/716
4,913,475 A * 4/1990 Bushnell et al. ..... 292/144
5,004,276 A * 4/1991 Hanley ..... 292/126
5,029,910 A * 7/1991 Genbauffe et al. ..... 292/110
5,072,974 A * 12/1991 Henne ..... 292/126
5,351,439 A * 10/1994 Takeda et al. ..... 49/28
5,472,065 A * 12/1995 Vergin ..... 185/40 R
5,532,521 A * 7/1996 Leininger ..... 307/10.2
5,765,884 A * 6/1998 Armbruster ..... 292/216
5,823,026 A * 10/1998 Finke ..... 70/276

(Continued)

FOREIGN PATENT DOCUMENTS

DE 1106639 1/1957
DE 196 15 021 A1 10/1997

(Continued)

*Primary Examiner* — Carlos Lugo
(74) *Attorney, Agent, or Firm* — Muirhead and Saturnelli, LLC

(57) ABSTRACT

An apparatus for opening a door of a climatic test cabinet, an incubator, an environmental simulation chamber or a freezer is suitable for unlocking the door when the door is closed and locked and for transferring it to an open position. The force for opening the door need no longer be applied by the user himself operating lever mechanisms and transferring the door to an open position, but instead the force for opening the door may be applied by the apparatus.

19 Claims, 5 Drawing Sheets

U.S. PATENT DOCUMENTS

| | | | | |
|---|---|---|---|---|
| 6,050,116 | A * | 4/2000 | Cole | 70/256 |
| 6,056,334 | A * | 5/2000 | Petzold et al. | 292/216 |
| 6,216,980 | B1 * | 4/2001 | Baudu et al. | 244/110 B |
| 6,338,508 | B1 * | 1/2002 | Kleefeldt | 292/201 |
| 6,470,719 | B1 * | 10/2002 | Franz et al. | 70/208 |
| 6,519,987 | B1 * | 2/2003 | Weyerstall | 70/257 |
| 6,776,442 | B2 * | 8/2004 | Edgar | 292/216 |
| 7,075,416 | B2 * | 7/2006 | Johnson et al. | 340/426.28 |
| 7,603,882 | B2 * | 10/2009 | Carbajal et al. | 70/267 |
| 7,823,936 | B2 * | 11/2010 | Compeau | 292/201 |
| 2001/0048227 | A1 * | 12/2001 | Kachouh | 292/216 |
| 2007/0013197 | A1 * | 1/2007 | Bender et al. | 292/201 |
| 2007/0138803 | A1 * | 6/2007 | Benoit et al. | 292/201 |
| 2007/0152455 | A1 * | 7/2007 | Ko et al. | 292/201 |
| 2009/0145182 | A1 * | 6/2009 | Bettin et al. | 70/237 |
| 2010/0102572 | A1 * | 4/2010 | Burmesch | 292/64 |

FOREIGN PATENT DOCUMENTS

| | | | |
|---|---|---|---|
| DE | 199 32 291 | A1 | 7/2000 |
| EP | 0 626 494 | A1 | 11/1994 |
| EP | 1 088 950 | A2 | 4/2001 |
| JP | 2005-127527 | A | 5/2005 |
| JP | 2005-326044 | A | 11/2005 |

* cited by examiner

APPARATUS FOR OPENING A DOOR OF A CLIMATIC TEST CABINET, AN INCUBATOR, AN ENVIRONMENTAL SIMULATION CHAMBER OR A FREEZER OR THE LIKE

TECHNICAL FIELD

This application relates to an apparatus for opening a door of a climatic test cabinet, an incubator, an environmental simulation chamber, a freezer or the like.

BACKGROUND OF THE INVENTION

There are known manual door closures with which opening forces must be applied by the operator via lever mechanisms, for example. In the case of climatic test cabinets, incubators, environmental simulation chambers, freezers or similar devices, the climate conditions prevailing in the interior of the device are different from those in the exterior, which may result in a vacuum in the interior of the device or in freezing over of the door seals, so it is difficult for the user to open the door of such a device.

Accordingly, it would be desirable to provide an apparatus for opening a door of a climatic test cabinet, an incubator, an environmental simulation chamber or a freezer which will allow simple operation by the user.

SUMMARY OF THE INVENTION

An apparatus according to an embodiment of the system described herein for opening a door of a climatic test cabinet, an incubator, an environmental simulation chamber or a freezer is characterized in that the apparatus is suitable for unlocking the door if the door is closed and locked and for transferring it to an open position.

The list of different types of cabinets is not conclusive but instead the apparatus according to the system described herein may be used with any type of laboratory cabinet or a similar device in which different climate conditions prevail in the interior than in the exterior. A lock is understood to refer to any mechanism which prevents the door from pivoting open simply from pulling on the door or from pressure on the door.

Thus, according to the system described herein, the force for opening the door need no longer be applied by the user himself operating the lever mechanisms and transferring the door to an open position but instead the force for opening the door is applied by the apparatus. This greatly simplifies the opening of the door for the user.

According to another embodiment of the system described herein, the apparatus may be suitable for transferring the door to a closed position, when the door is open, and for locking it. This prevents the user from having to apply human force to transfer the door to the closed position but instead the corresponding force is applied by the apparatus.

The apparatus may be pneumatically or hydraulically driven, but the apparatus may be driven electromechanically because this yields a simple design of the apparatus.

According to another embodiment of the system described herein, the apparatus has a control unit, which may be activatable by at least one release switch. The release switch is especially user friendly because the user is able to operate the release switch without exerting much force, which is also possible in particular when the user is holding in his hand the objects which are to be introduced into or removed from the climatic test cabinet, incubator, environmental simulation chamber or freezer, because a release switch may also be operated especially easily by using an arm or an elbow in particular.

The control unit may be activatable by the release switch when the door is closed to unlock the door and transfer it to an open position. According to an embodiment, the control unit may be activatable by the release switch by transferring the door from an open position into an activation position in order to transfer the door to a closed position and to lock it. According to another embodiment of the system described herein, a first release switch is provided for activation of the control unit when the door is closed, and a second release switch is provided for activation of the control unit when the door is open. In particular the release switch allows operation by an arm or an elbow when the door is closed, for example, so that the door is automatically transferred to an open position by the apparatus, while the release switch is activatable for closing the door by transferring the door from an open position to an activation position, for example, by the user simply pushing the door again with an elbow or even a leg or a foot until reaching the activation position, in which the release switch is activated to transfer the door completely to the closed position and to lock it, which permits especially simple use.

According to another embodiment of the system described herein, the apparatus may have a power supply and may also be suitable for keeping the door in the closed and locked position even when the power supply is turned off. In the event of a power failure in particular, this therefore ensures that the climatic test cabinets, incubators, environmental simulation chambers, freezers or the like, which may contain sensitive specimens, do not open inadvertently, so that the climate conditions prevailing in the corresponding device may be maintained for a longer period of time.

The apparatus may have a linear drive and a pivot lever, which is pivotably connected to the linear drive via a connecting joint and has a cam, such that the pivot lever is designed to be mounted pivotably about a swivel pin. This yields a simple structural design of the apparatus for opening a door.

The linear drive may be displaced essentially perpendicularly to the direction of movement of the door, which makes it possible in particular for the door to be held in the closed and locked position even in the event of a power failure because a force perpendicular to the linear drive essentially does not cause any movement of the linear drive.

The linear drive is mounted on its end facing away from the pivot lever, may be pivotable about a swivel pin, and may be pivotable by only a few angle degrees to allow rotation of the pivot lever when the linear drive is linearly displaced. Alternatively, the connecting joint between the pivot lever and the linear drive may be supported in an elongated hole to allow rotation of the pivot lever when the linear drive is linearly displaced.

An embodiment of the linear drive having a simple design is obtained when it is designed as an electromechanically driven spindle drive.

The cam is designed in particular in such a way that when the pivot lever is rotated, the door is transferred from the closed position into the open position or from an open position into the closed position. The cam of the pivot lever may have a first section, which transfers a closure element situated on the door and thus likewise the door itself from a closed position to an open position when the linear drive is transferred from a first position to a second position. The cam of the pivot lever may have a first section, which transfers a closure element situated on the door and thus at the same time transfers the door itself from an open position to a closed position when the linear drive is transferred from a first position into a second position. In this way, automatic opening and closing of the door are made possible in a structurally simple manner.

The first section and/or the second section in particular has/have a curved design, in particular curved in the same direction and in particular curved around the swivel pin of the pivot lever.

According to another embodiment of the system described herein, the cam may be designed as a crank guide for the closure element, so this yields a structurally simple mechanism.

According to another embodiment of the system described herein, the angle formed between the longitudinal axis of the linear drive and the connecting axis between the connecting joint between the linear drive and the pivot lever and the swivel pin of the pivot lever may be less than or equal to 90° in the closed position of the door, and particularly approximately 87°, which ensures that the door will remain in the closed position in the event of a power failure in particular and opening of the door by the force applied by a person is prevented.

The apparatus according to the system described herein for opening a door may be used in particular on climatic test cabinets, incubators, environmental simulation chambers, freezers or the like. In particular the system described herein relates to a climatic test cabinet, an incubator, an environmental simulation chamber, a freezer or the like having an apparatus according to the system described herein for opening a door.

BRIEF DESCRIPTION OF THE DRAWINGS

Embodiments of the system described herein are explained in greater detail below on the basis of the figures, which are briefly described as follows.

FIG. 4*c* shows a section along line A-A from FIG. 4*b*.

FIG. 4*d* shows a section along line B-B from FIG. 4*b*.

DETAILED DESCRIPTION OF VARIOUS EMBODIMENTS

Figure 1:
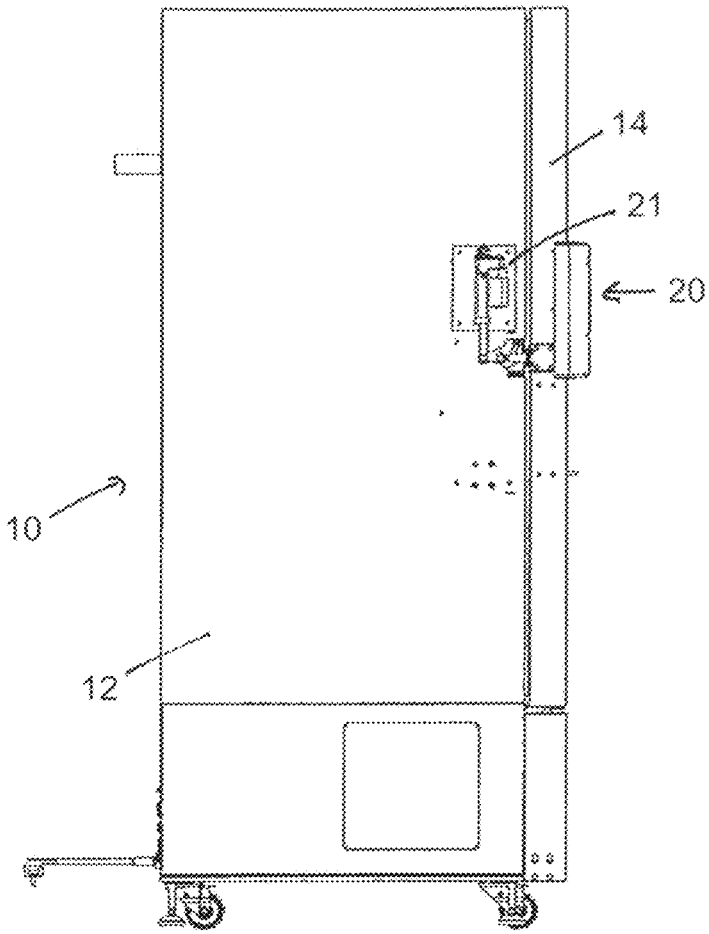
FIG. 1 shows a cabinet having an apparatus for opening the door according to an embodiment of the system described herein.

FIGS. 1 through 6 show various views of an apparatus 20 for opening a door 14 on a cabinet 10, which is designed in particular as a climatic test cabinet, an incubator, an environmental simulation chamber, a freezer or the like, where the same parts are labeled with the same reference numerals and, to simplify the diagrams, not all reference numerals are shown in all the figures.

FIG. 1 shows a side view of cabinet 10, where door 14 is shown in a closed position and is held and locked in the closed position by apparatus 20, which is attached to a side wall 12 of cabinet 10. Apparatus 20 is situated on a retaining plate 21 in particular and is attached to side wall 12 of cabinet 10 by retaining plate 21.

Apparatus 20 has a linear drive 22, which is designed in particular as a spindle drive having a spindle 26 or a pusher rod and a motor 24. Linear drive 22, in particular spindle 26, has a longitudinal axis 1. A pivot lever 30 is mounted to pivot around connecting joint 27 via a connecting joint 27 on one end of spindle 26.

The end of linear drive 22 facing away from pivot lever 30 is mounted to pivot around a swivel pin 28 on retaining plate 21. Swivel pin 28 is situated on retaining plate 21 and is secured in its relative position on retaining plate 21.

Pivot lever 30 is mounted to pivot about a swivel pin 34 on retaining plate 21 and has a first arm 31 and a second arm 32, which are situated in particular on both sides of swivel pin 34. Swivel pin 34 is mounted on retaining plate 21 and is secured in its relative position on retaining plate 21. Connecting joint 27 between pivot lever 30 and spindle 26 is situated on the free end of first arm 31. Connecting joint 27 is displaceable in its relative position with respect to the retaining plate and has no direct connection to retaining plate 21.

A cam 36 having a first section 37 and a second section 38 is situated in second arm 32 of pivot lever 30. Cam 36 having first section 37 and second section 38 forms in particular a crank guide for a closure element 16 situated on door 14. Closure element 16 is provided as a U-shaped element, which engages in cam 36 of second arm 32 of pivot lever 30 and in particular is guided by first section 37 as well as second section 38. Cam 36 in particular makes it possible for apparatus 20 to be able, when door 14 is closed and locked, to transfer door 14 to an open position and conversely, when door 14 is open, to be able to transfer door 14 to a closed position.

Figure 2:
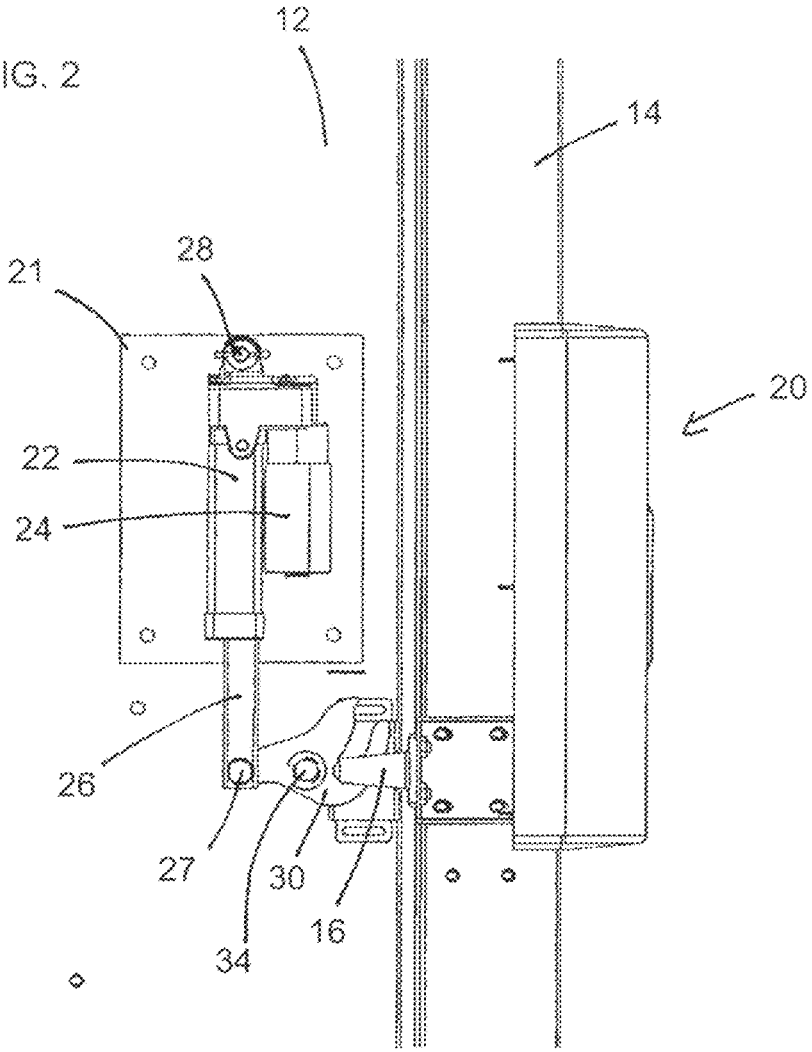
FIG. 2 shows an enlarged detail from FIG. 1.
Figure 3:
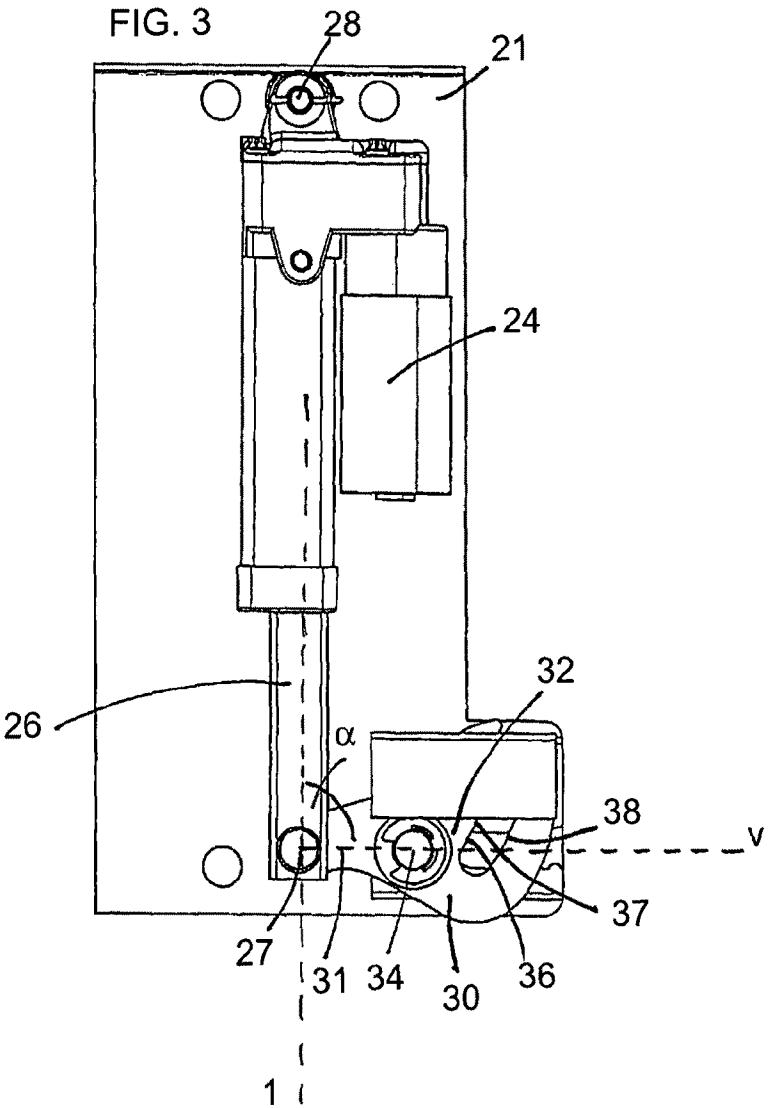
FIG. 3 shows a side view of the apparatus for opening a door according to FIG. 2, showing the drive in a first position.

FIG. 2 shows door 14 in a closed position and a linear drive 22 of the apparatus 20 in a first position. FIG. 3 shows a side view of the apparatus 20 according to FIG. 2. Longitudinal axis 1 of spindle 26 and a connecting axis v running through connecting joint 27 and swivel pin 34 of pivot lever 30 form an angle $\alpha$ amounting to approximately 90° or less, specifically approximately 85° to 89°, and more specifically, approximately 87°. Closure element 16 is at the lowest point of cam 36. Door 14 is held by closure element 16 and pivot lever 30 in the closed position and is thus locked. Even if an attempt is made to open door 14, it is possible to hold door 14 in the closed position because of the arrangement of spindle 26, pivot lever 30, swivel pin 34 and cam 36 because door 14 is displaced essentially perpendicularly to longitudinal axis 1 of spindle 26 and thus no pivoting movement of pivot lever 30 and no movement of linear drive 22 may be initiated by the direction of movement of door 14.

Figure 4A:
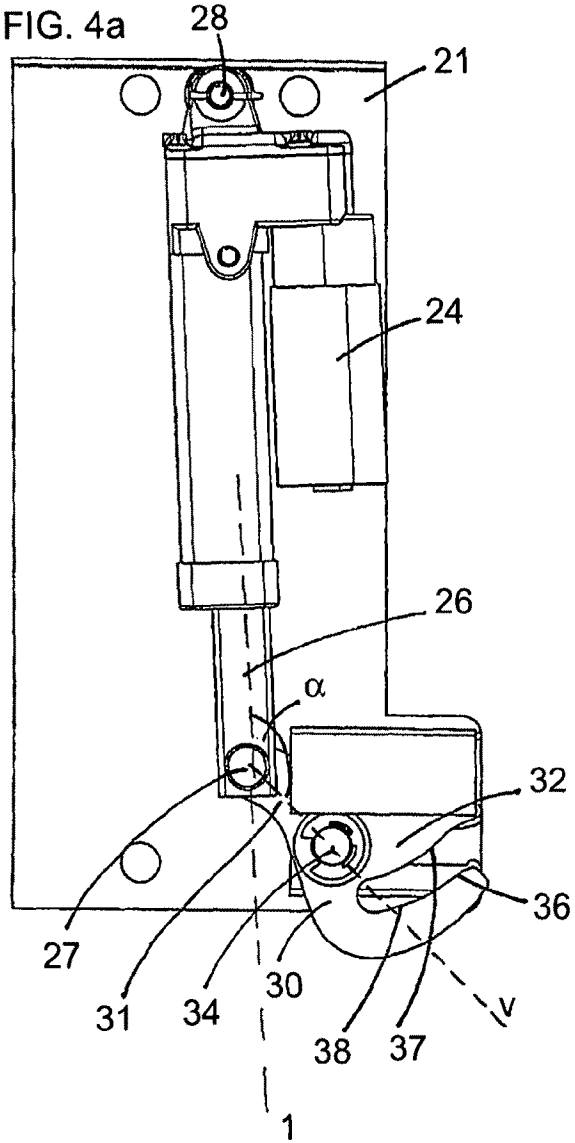
FIG. 4*a* shows the apparatus according to FIG. 3, illustrating the drive in a second position.
Figure 4B:
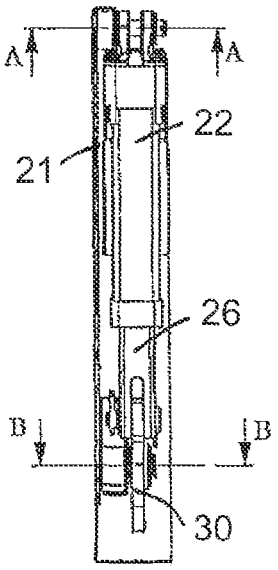
FIG. 4*b* shows a front view of the apparatus according to FIG. 4*a*.
Figure 4B:
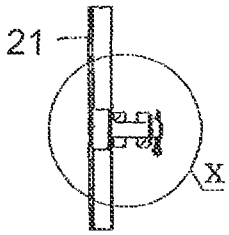
Figure 4B:
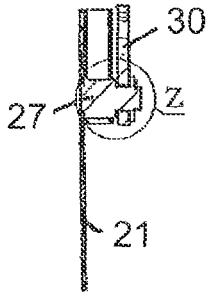
Figure 4E:
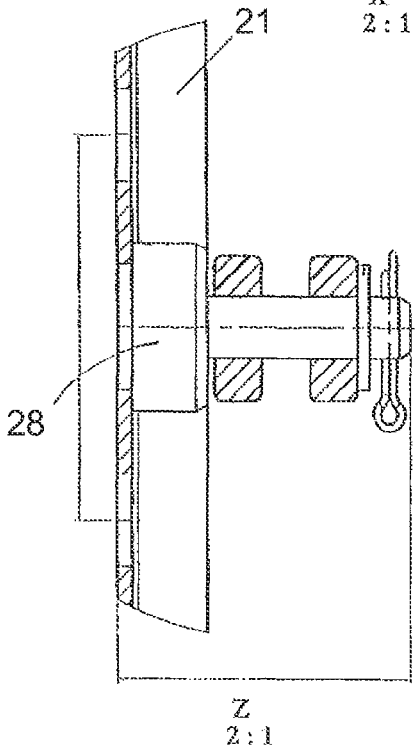
FIG. 4*e* shows an enlarged detail from FIG. 4*c*.
Figure 4F:
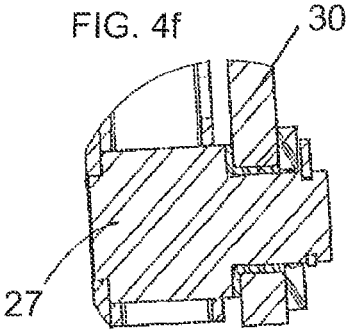
FIG. 4*f* shows an enlarged detail from FIG. 4*d*.
Figure 4G:
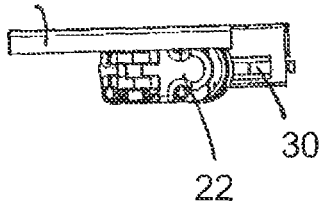
FIG. 4*g* shows a view from below of the apparatus according to FIG. 4*a*.
Figure 4H:
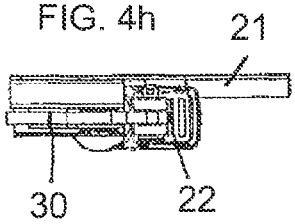
FIG. 4*h* shows a view from above of the apparatus according to FIG. 4*a*.
Figure 5:
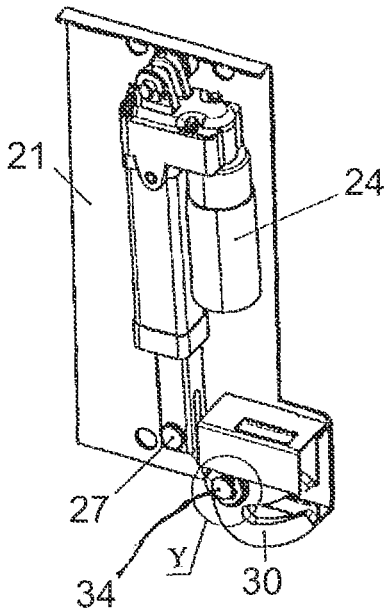
FIG. 5 shows a perspective view of the apparatus according to FIG. 4*a*.
Figure 6:
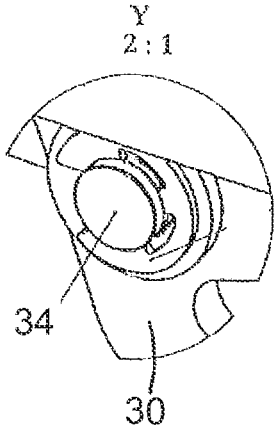
FIG. 6 shows an enlarged detail from FIG. 5.

Apparatus 20 has a control unit, which has a power supply. In addition, a first release element by which linear drive 22 is activated when operated, in particular turning spindle 26 and shortening the length of linear drive 22, is situated on the front surface of door 14, for example, and linear drive 22 is transferred from the first position into a second position, where angle $\alpha$ becomes larger and pivot lever 30 is pivoted about swivel pin 34. In order for this pivoting movement to be executable by linear drive 22, linear drive 22 pivots by a few degrees about swivel pin 28. FIG. 4*a* shows the apparatus 20 according to FIG. 3, illustrating the drive 22 in the second position. FIG. 4*b* shows a front view of the apparatus 20 according to FIG. 4*a*. FIG. 4*c* shows a section along line A-A from FIG. 4*b*. FIG. 4*d* shows a section along line B-B from FIG. 4*b*. FIG. 4*e* shows an enlarged detail from FIG. 4*c*. FIG. 4*f* shows an enlarged detail from FIG. 4*d*. FIG. 4*g* shows a view from below of the apparatus 20 according to FIG. 4*a*. FIG. 4*h* shows a view from above of the apparatus 20 according to FIG. 4*a*. FIG. 5 shows a perspective view of the apparatus 20 according to FIG. 4*a*. FIG. 6 shows an enlarged detail from FIG. 5.

When linear drive 22 moves out of the first position and into the second position, closure element 16 runs onto the first section of cam 36 of second arm 32 of pivot lever 30, where the design of first section 37 causes closure element 16 to be pushed out of cam 36. This is achieved in particular by the fact that first section 37 is slightly curved, in particular curved around swivel pin 34 of pivot lever 30. Closure element 16 is thus transferred away from the lowest point in cam 36 when linear drive 22 is transferred out of the first position and into the second position, so that door 14 is also transferred from the closed position to an open position. The forces for opening the door, which are needed in particular when a vacuum is prevailing in the interior of cabinet 10 or when the door gaskets are frozen over, are thus applied by apparatus 20 to open the door after the user simply operates a first release element. The first release element may be designed to have such a large area that it is operable merely by touch or by slight pressure by an arm, an elbow or the like, so that activation of the door opening is possible even if the user has no free hands, for example.

To further simplify use for the user, pivot lever 30, due to its cam 36, in particular the design of second section 38 of cam 36, additionally allows door 14 to be automatically closed and locked by apparatus 20 as soon as it has been pressed lightly by the user with the help of an arm or a leg, for example, and in particular has been transferred to an activation position in which door 14 is still open. In transferring door 14 to the activation position, another release switch, which is located in the area of the contact surface between door 14 and the remaining elements of cabinet 10, for example, will activate apparatus 20 in such a way that linear drive 22 is transferred from the second position into the first position. In the activation position, door 14 is in contact with the release element on the one hand. However, this activation position is also selected in such a way that closure element 16 already comes into contact with the external end of cam 36, in particular second section 38 of cam 36. If linear drive 22 is transferred from the second position to the first position, pivot lever 30 tilts about swivel pin 34 and closure element 16 runs onto second section 38 of cam 36 to the lowest point of cam 36, the design of cam 36, in particular the curved design of second section 38, which is curved around swivel pin 34 in particular, achieving the result that closure element 16 and thus door 14 are pulled into the closed position without the user having to exert any force. In this way, the closing of the door is simplified for the user on the one hand, while on the other hand reliable closing of the door is ensured.

The curves of first section 37 and second section 38 run in the same direction and, in particular, may run essentially in parallel, thus resulting in a crank guide for closure element 16.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An apparatus for opening a door of a climatic test cabinet, an incubator, an environmental simulation chamber or a freezer, wherein the apparatus unlocks the door and transfers the door to an open position when the door is closed and locked, the apparatus comprising:

a linear drive having a longitudinal axis; and a pivot lever pivotably connected to the linear drive by a connecting joint, wherein the pivot lever includes a cam that pivotably mounts the pivot lever about a swivel pin, wherein the cam of the pivot lever includes a first section and a second section, wherein, when the linear drive is transferred from a first position into a second position, the first position and the second position being along the longitudinal axis of the linear drive, the first section of the cam transfers a closure element on the door from an element closed position to an element open position, wherein, after engagement of the second section of the cam with the closure element, when the linear drive is transferred from the second position into the first position, the second section of the cam transfers the closure element on the door from the element open position into the element closed position, wherein at least one of: the first section of the cam or the second section of the cam is curved, and wherein the linear drive is coupled to pivot about a second swivel pin on an end of the linear drive facing away from the pivot lever.

2. The apparatus as recited in claim 1, wherein the apparatus moves the door, when the door is open, into a closed position and locks the door.

3. The apparatus as recited in claim 2, wherein the apparatus has a power supply and holds the door in the closed and locked position when the power supply is turned off.

4. The apparatus as recited claim 1, wherein the apparatus is driven electromechanically.

5. The apparatus as recited in claim 1, further comprising:

a control unit which is activatable by at least one release switch.

6. The apparatus as recited in claim 5, wherein the control unit is activatable by the release switch when the door is closed, to unlock the door and transfer the door to the open position.

7. The apparatus as recited in claim 5, wherein the control unit is activatable by moving the door out of the open position into an activation position by the release switch to transfer the door to a closed position and to lock the door.

8. The apparatus as recited in claim 1, wherein the linear drive is displaced along a longitudinal axis that is substantially perpendicularly to the direction of movement of the door.

9. The apparatus as recited in claim 1, wherein the linear drive is an electromechanically driven spindle drive.

10. The apparatus as recited in claim 1, wherein the first section of the cam and the second section are curved.

11. The apparatus as recited in claim 10, wherein the first section of the cam and the second section of the cam are curved in the same direction and are curved partially about the swivel pin of the pivot lever.

12. The apparatus as recited in claim 1, wherein the cam is a crank guide for the closure element.

13. The apparatus as recited in claim 1, wherein an angle enclosed between the longitudinal axis of the linear drive and a connecting axis between the connecting joint and the swivel pin of the pivot lever is less than or equal to 90° in the closed position of the door.

14. A climatic enclosure, comprising:

a door; and an apparatus for opening the door, wherein the apparatus unlocks the door and transfers the door to an open position when the door is closed and locked, and wherein the apparatus includes:

a linear drive having a longitudinal axis; and a pivot lever pivotably connected to the linear drive by a connecting joint, wherein the pivot lever includes a cam that pivotably mounts the pivot lever about a swivel pin, wherein the cam of the pivot lever includes a first section and a second section, wherein, when the linear drive is transferred from a first position into a second position, the first position and the second position being along the longitudinal axis of the linear drive, the first section of the cam transfers a closure element on the door from an element closed position to an element open position, wherein, after engagement of the second section of the cam with the closure element, when the linear drive is transferred from the second position into the first position, the second section of the cam transfers the closure element on the door from the element open position into the element closed position, wherein at least one of: the first section of the cam or the second section of the cam is curved, and wherein the linear drive is coupled to pivot about a second swivel pin on an end of the linear drive facing away from the pivot lever.

15. The climatic enclosure as recited in claim 14, wherein the apparatus moves the door, when the door is open, into a closed position and locks the door.

16. The climatic enclosure as recited in claim 14, wherein the climatic enclosure is at least one of: a climatic test cabinet, an incubator, an environmental simulation chamber or a freezer.

17. An apparatus for operating a door of an enclosure, the apparatus comprising:

a linear drive having a longitudinal axis; and a pivot lever pivotably connected to the linear drive by a connecting joint, wherein the pivot lever includes a cam that pivotably mounts the pivot lever about a swivel pin, wherein the cam of the pivot lever includes a first section and a second section, wherein, when the linear drive is transferred from a first position into a second position, the first position and the second position being along the longitudinal axis of the linear drive, the first section of the cam transfers a closure element on the door from an element closed position to an element open position, wherein, after engagement of the second section of the cam with the closure element, when the linear drive is transferred from the second position into the first position, the second section of the cam transfers the closure element on the door from the element open position into the element closed position, and wherein at least one of: the first section of the cam or the second section of the cam is curved, wherein the longitudinal axis of the linear drive is substantially perpendicular to movement of the door when moving from an open position to a closed position, and wherein the linear drive is coupled to pivot about a second swivel pin on an end of the linear drive facing away from the pivot lever.

18. The apparatus as recited in claim 17, wherein the first section of the cam and the second section are curved, and wherein the first section of the cam and the second section of the cam are both curved in the same direction and are curved at least partially about the swivel pin of the pivot lever.

19. The apparatus as recited in claim 17, wherein the linear drive is an electromechanical spindle drive that includes a motor and a spindle aligned along the longitudinal axis, wherein an end of the spindle is coupled to the pivot lever by the connecting joint.

* * * * *